US010996624B2

(12) United States Patent
Noguchi

(10) Patent No.: US 10,996,624 B2
(45) Date of Patent: May 4, 2021

(54) CHARGING DEVICE INCLUDING A HEATER THAT DIRECTLY HEATS A HOUSING THAT HOUSES A CHARGING ROLL OR THE CHARGING ROLL

(71) Applicant: FUJI XEROX CO., LTD., Tokyo (JP)

(72) Inventor: Ayumi Noguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/751,280

(22) Filed: Jan. 24, 2020

(65) Prior Publication Data

US 2021/0072700 A1 Mar. 11, 2021

(30) Foreign Application Priority Data

Sep. 6, 2019 (JP) ..... JP2019-162665

(51) Int. Cl.
*G03G 15/00* (2006.01)
*G03G 15/02* (2006.01)
*G03G 21/20* (2006.01)

(52) U.S. Cl.
CPC ..... *G03G 21/203* (2013.01); *G03G 15/0233* (2013.01); *G03G 15/0258* (2013.01)

(58) Field of Classification Search
CPC ..... G03G 15/0216; G03G 15/0258; G03G 21/203
USPC ..... 399/44, 94, 96, 97, 176
See application file for complete search history.

(56) References Cited

U.S. PATENT DOCUMENTS 3,665,181 A * 5/1972 Cobb ..... G03G 15/0291 250/326
5,479,243 A * 12/1995 Kurokawa et al. ..... G03G 15/0216 399/176
5,805,954 A * 9/1998 Takahashi ..... G03G 15/0266 399/44

FOREIGN PATENT DOCUMENTS

JP 2005-345796 A 12/2005
JP 2006-258974 A 9/2006
JP 2011-53440 A1 3/2011
JP 2013-088769 A 5/2013

* cited by examiner

*Primary Examiner* — William J Royer
(74) *Attorney, Agent, or Firm* — Sughrue Mion, PLLC

(57) ABSTRACT

A charging device includes: a charging roll configured to charge a photoconductor; a housing that houses the charging roll; and a heating unit that directly heats the housing or the charging roll. In the charging device, the heating unit may be disposed in contact with an outside or inside of the housing, and at least a part of the outside or inside of the housing may be covered with a thermally conductive member.

11 Claims, 14 Drawing Sheets

CHARGING DEVICE INCLUDING A HEATER THAT DIRECTLY HEATS A HOUSING THAT HOUSES A CHARGING ROLL OR THE CHARGING ROLL

CROSS-REFERENCE TO RELATED APPLICATIONS

This application is based on and claims priority under 35 USC 119 from Japanese Patent Application No. 2019-162665 filed Sep. 6, 2019.

BACKGROUND

(i) Technical Field

The present disclosure relates to a charging device and an image forming apparatus having the same.

(ii) Related Art

In the related art, as this type of image forming apparatus, for example, those disclosed in JP-A-2011-53440, JP-A-2005-345796, JP-A-2006-258974, and JP-A-2013-88769 are already known.

JP-A-2011-53440 discloses an image forming apparatus including a charging charger having a grid that controls a charging potential in the vicinity of a photosensitive drum, and a heater disposed along a major scanning direction of the photosensitive drum, which is the longitudinal direction of the charging charger, in which the heater is not in contact with the grid of the charging charger and a portion facing the grid of the photosensitive drum, and is at least as long as the image forming region in the major scanning direction.

JP-A-2005-345796 discloses an image forming apparatus in which in a case of a standby state in which image formation is not performed for a long time, a thermostat switch is turned on and a heat source is constantly energized to prevent a temperature in an image forming apparatus main body from becoming lower than 40° C., and in a case of a processing execution state in which a toner image is heated and fixed, the thermostat switch is turned off, and an energization time to the heat source is controlled to be short with another thermostat, thereby reducing power consumption and preventing the temperature from rising excessively.

JP-A-2006-258974 discloses an image forming apparatus including a temperature measuring unit that measures a temperature of a tip end of a cleaning blade; and a blade temperature control unit that heats the tip end so that the temperature of the tip end is higher than a Tan δ peak temperature of a rubber material constituting the tip end and lower than a glass transition temperature of toner in a case where after receiving the measurement result of the temperature measuring unit, the temperature of the tip end of the cleaning blade is equal to or lower than the Tan δ peak temperature.

JP-A-2013-88769 discloses an image forming apparatus including a blowing unit that is provided with a first air passage for cooling a developing device, and a second air passage for sending air to a charging device, and sends the air that has cooled the developing device in the first air passage to the second air passage, in which while preventing a decrease in developing performance, the occurrence of image flow is prevented by heating and drying the air leading to the charging device to a temperature higher than the outside air.

SUMMARY

Aspects of non-limiting embodiments of the present disclosure relate to preventing image quality defects caused by water absorption by a discharge product generated between a photoconductor and a charging roll in a system where the charging roll is configured to charge the photoconductor.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a charging device including: a charging roll configured to charge a photoconductor; a housing that houses the charging roll; and a heating unit that directly heats the housing or the charging roll.

BRIEF DESCRIPTION OF THE DRAWINGS

Exemplary embodiments of the present invention will be described in detail based on the following figures, wherein.

DETAILED DESCRIPTION

Outline of Exemplary Embodiment

Figure 1A:
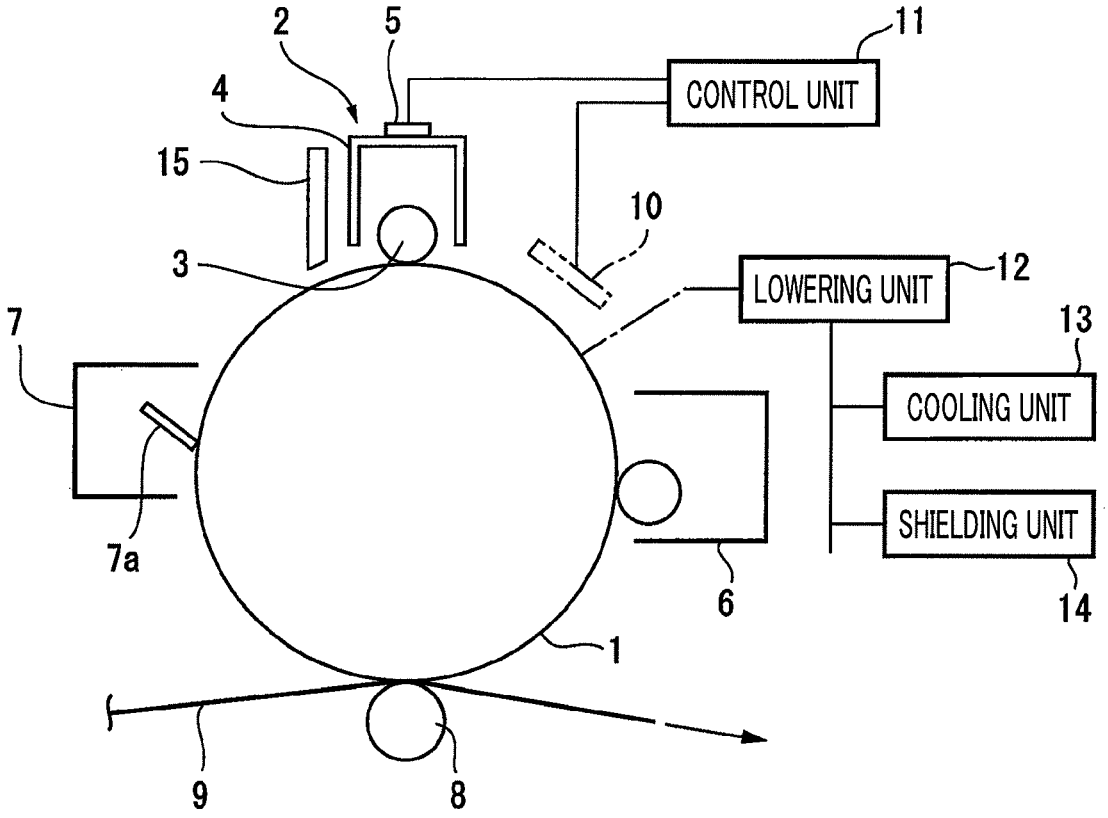
FIG. 1A is an explanatory diagram illustrating an outline of an exemplary embodiment of an image forming apparatus to which the present disclosure is applied.

FIG. 1A illustrates an outline of the exemplary embodiment of an image forming apparatus to which the present disclosure is applied.

In FIG. 1A, the image forming apparatus is provided with a photoconductor 1 on which an image is held; a charging device 2 that charges the photoconductor 1; a developing machine 6 that is provided downstream of the charging device 2 in a rotational direction of the photoconductor 1 and develops an electrostatic latent image formed after charging the photoconductor 1 with a developer; a cleaning device 7 that is provided upstream of the charging device 2 in the rotational direction of the photoconductor 1 and cleans a residue remaining on the photoconductor 1.

Figure 1B:
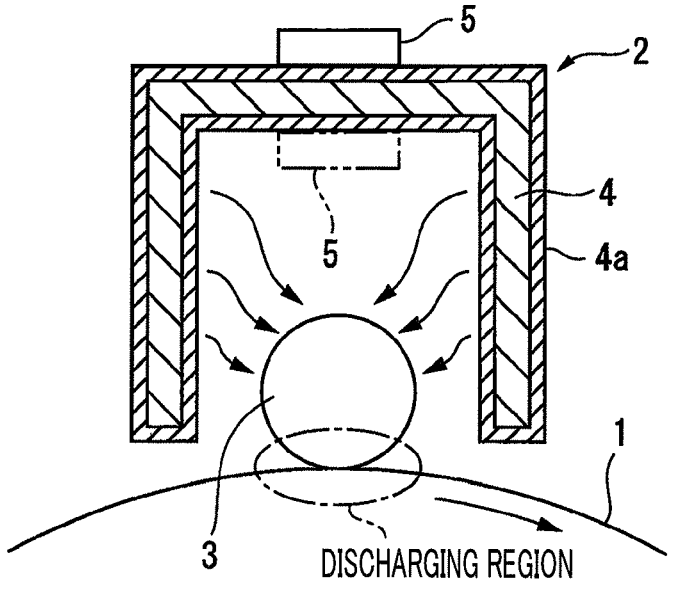
FIG. 1B is an explanatory diagram illustrating major parts of a charging device used in FIG. 1A.

In particular, in this exemplary embodiment, as illustrated in FIGS. 1A and 1B, the charging device 2 includes a charging unit 3 disposed in contact with the photoconductor 1, a housing 4 that houses the charging unit 3, and a heating unit 5 that directly heats the housing 4 or the charging unit 3. The word "house" as used herein refers to a state in which it is disposed so as to face at least a part of an outer peripheral surface of the charging unit 3.

Note that, in this exemplary embodiment, a latent image writing unit (not shown) that writes an electrostatic latent image on the photoconductor 1 is provided downstream of the charging device 2 in the rotational direction of the photoconductor 1 and upstream of the developing machine 6 in the rotational direction of the photoconductor 1, and a developed image on the photoconductor 1 developed by the developing machine 6 is transferred to a transfer medium 9 (including an intermediate transfer body without limiting to a recording material) by a transfer unit 8.

In such technical units, the photoconductor 1 may be in any form having a photosensitive layer on a conductive substrate, and a protective layer may be provided on a surface layer, or an undercoat layer may be appropriately provided between the base body and the photosensitive layer. In addition, an organic photoconductor using an organic photosensitive material is often used as the photosensitive layer; however, the exemplary embodiment is not limited thereto, and a photosensitive layer using an inorganic photosensitive material such as an amorphous silicon layer may be used. Furthermore, the form of the photoconductor 1 is not limited to a drum shape, but includes a belt shape.

As for the configuration of the charging device 2, the charging unit 3 may be disposed in contact with a photoconductor 1, or a small gap may exist between the charging unit 3 and the photoconductor 1 as long as the charging unit 3 is configured to charge the photoconductor 1. In addition, an aspect in which a charging voltage including an AC component is applied between the charging unit 3 and the photoconductor 1 is usually employed.

Further, the housing 4 may be open at least on the photoconductor 1 side, and may hold the charging unit 3 to face the opening.

Furthermore, the heating unit 5 includes an aspect in which the charging unit 3 is directly heated and an aspect in which the housing 4 is directly heated to heat the charging unit 3 in the housing 4. The expression "directly heated" as used herein refers to that there is a line segment which does not intersect the heating unit 5 and a shielding member other than the heating target when the heating unit 5 and the heating target (the housing 4 or the charging unit 3) are connected by a line segment. For this reason, the aspect in which the housing 4 is directly heated is an aspect in which the housing 4 is disposed in contact with the housing 4, but includes an aspect in which the housing 4 is disposed in a non-contact manner via a bracket. In addition, as the aspect in which the charging unit 3 is directly heated, the charging unit 3 may be disposed in contact or non-contact manner as long as the charging unit 3 is disposed in a portion in the housing 4 where the charging unit 3 is directly heated.

Next, a typical aspect of the charging device 2 will be described.

First, as a typical aspect of the heating unit 5, an aspect in which the heating unit 5 is disposed in contact with the outside or the inside of the housing 4 can be exemplified. In this exemplary embodiment, the housing 4 of the charging device 2 is directly heated.

In this exemplary embodiment, as a typical aspect of the heating unit 5, as illustrated in FIG. 1B, an aspect in which the housing 4 is at least partially covered with a thermally conductive member 4*a* on the outside or inside, and the heating unit 5 is disposed in contact with the thermally conductive member 4*a* can be exemplified. In this exemplary embodiment, the heat of the heating unit 5 is transmitted to the housing 4 through the thermally conductive member 4*a*. The "thermally conductive member 4*a*" as used herein means a metal such as copper having a higher heat conduction coefficient than the material of the housing 4.

Alternatively, the heating unit 5 may be disposed to directly heat the surface of the photoconductor 1 as well. In this exemplary mode, the surface of the photoconductor 1 is also directly heated, except that the surface of the photoconductor 1 is indirectly heated by raising the internal temperature in the vicinity of the photoconductor 1.

Furthermore, the housing 4 may also have a heat shielding portion (not illustrated in FIGS. 1A and 1B) that shields heat from the heating unit 5 at least either upstream or downstream of the photoconductor 1 in the rotational direction. In this exemplary mode, the heat shielding portion is provided in at least a part of the housing 4 upstream or downstream of the photoconductor 1 in the rotational direction so that the heat from the heating unit 5 does not reach a region other than a region facing the charging device 2 of the photoconductor 1. The heat shielding portion as referred herein includes an aspect in which a heat shielding wall portion protrudes from an opening edge of the housing 4 (storing container) and an aspect in which the thermally conductive member 4*a* is not provided on an outer wall of the housing 4.

Further, a typical aspect of the image forming apparatus will be described.

First, in the exemplary embodiment, a typical aspect of the image forming apparatus includes an aspect in which the charging device 2 includes the heating unit 5. However, the exemplary embodiment is not limited thereto, and as another typical aspect of the image forming apparatus, an aspect in which a photoconductor heating unit 10 that is disposed in non-contact with the charging device 2 and is provided separately from the heating unit 5 of the charging device 2 to heat the surface of the photoconductor 1 is exemplified. This exemplary embodiment is an aspect of including the photoconductor heating unit 10 that heats the surface of the photoconductor 1 separately from the heating unit 5 that heats the charging unit 3 or the housing 4.

In this exemplary embodiment, the photoconductor heating unit 10 directly heats the surface of the photoconductor 1. In addition, the photoconductor 1 may be indirectly heated by heating the environment surrounding the photoconductor 1.

Further, a control unit 11 may also be provided to control the heating unit 5 and the photoconductor heating unit 10 in the charging device 2.

Here, as a typical aspect of the control unit 11, there is an aspect in which the heating conditions of the heating unit 5 and the photoconductor heating unit 10 are controlled depending on the information on humidity at or around the photoconductor 1. This exemplary embodiment also includes an aspect in which the heating unit 5 is operated in a predetermined high humidity environment and the heating unit 5 is not operated in a low humidity environment.

Further, the image forming apparatus may include a lowering unit 12 that lowers the surface temperature of the photoconductor 1 in a region between the charging device 2 and the developing machine 6 downstream of the photoconductor 1 in the rotational direction. In this exemplary embodiment, the surface temperature of the photoconductor 1 is lowered by the lowering unit 12 so that the photoconductor 1 heated in the charging area does not reach the developing area in the high temperature state as it is, thereby preventing excessive overheating of the developer (or toner) in the developing area by the developing machine 6.

Here, there is an aspect in which the lowering unit 12 is typically a cooling unit 13 that cools the surface of the photoconductor 1 in such a manner as not to be in contact with the surface of the photoconductor 1. The cooling unit 13 referred herein is not limited to air cooling, but includes an aspect in which a heat dissipation member is brought into contact with the back surface of the base body of the photoconductor 1.

Further, as another typical aspect of the lowering unit 12, there is an aspect in which a shielding unit 14 is provided between the charging device 2 and the developing machine 6 so as to shield heat from the heating unit 5 of the charging device 2.

Furthermore, the lowering unit 12 may lower the temperature of the surface of the photoconductor 1 facing the developing machine 6 to a temperature equal to or lower than the allowable heat-resistant temperature of the developer. The allowable heat-resistant temperature of the developer means the softening point of the toner contained in the developer, and the measurement method may be appropriately selected.

The image forming apparatus may further include a shielding unit 15 provided so that the heat from the heating unit 5 of the charging device 2 is shielded in a region between the charging device 2 and the cleaning device 7 upstream of the photoconductor 1 in the rotational direction. In this exemplary mode, the heat of the heating unit 5 is not affected by the cleaning device 7. Here, when the heat of the heating unit 5 becomes a factor for heating the cleaning unit 7*a*, there is a concern that the developer (toner) residue cleaned by the cleaning unit 7*a* is melted and accumulated between the cleaning unit 7*a* and the photoconductor 1, and the frictional resistance at a contact portion between the cleaning unit 7*a* and the photoconductor 1 is increased, and excessive torque acts on the photoconductor 1.

Hereinafter, the exemplary embodiment will be described in more detail with reference to the accompanying drawings.

First Exemplary Embodiment

Figure 2:
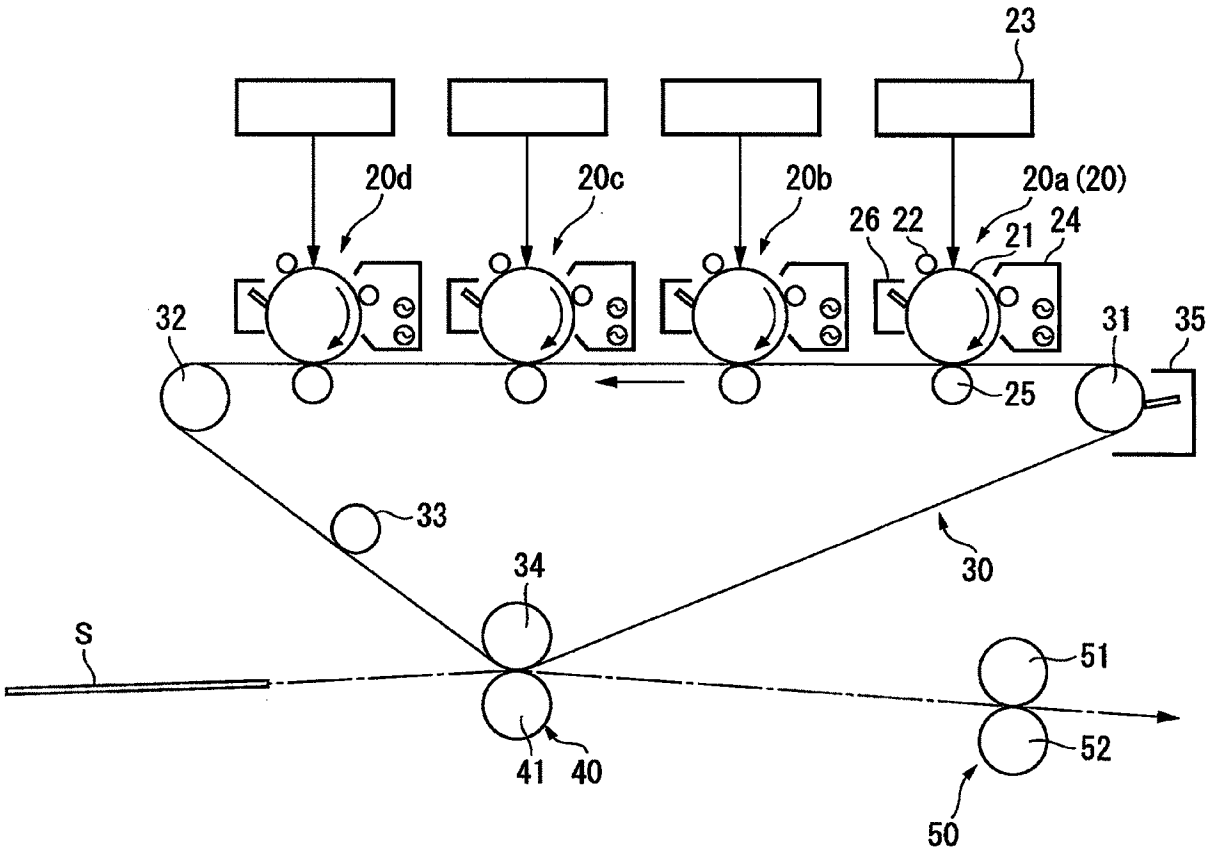
FIG. 2 is an explanatory diagram illustrating an overall configuration of an image forming apparatus according to a first exemplary embodiment.

FIG. 2 illustrates an overall configuration of an image forming apparatus according to a first exemplary embodiment.

Overall Configuration of Image Forming Apparatus

In FIG. 2, in an apparatus housing (not shown), the image forming apparatus is provided with an image forming portion 20 (specifically, 20*a* to 20*d*) that forms plural color component images (yellow, magenta, cyan, and black in the exemplary embodiment); a belt-shaped intermediate transfer body 30 that sequentially transfers (primary transfer) and holds each color component image formed in each image forming portion 20; a secondary transfer device (collective transfer device) 40 that secondarily transfers (collectively transfers) each color component image transferred onto the intermediate transfer body 30 to a paper S as a recording medium; and a fixing device 50 that fixes the secondarily transferred image on the paper S.

Image Forming Portion

In this exemplary embodiment, each image forming portion 20 (20*a* to 20*d*) includes a drum-shaped photoconductor 21, and in the vicinity of each photoconductor 21, a charging device 22 in which the photoconductor 21 is charged; an exposure device 23 such as a laser scanning device in which an electrostatic latent image is written on the charged photoconductor 21; a developing machine 24 that develops the electrostatic latent image written on the photoconductor 21 with each color component toner; a primary transfer device 25 such as a transfer roll for transferring a toner image on the photoconductor 21 to the intermediate transfer body 30; and a cleaning device 26 that cleans residual toner on the photoconductor 21 are arranged.

Intermediate Transfer Body

The intermediate transfer body 30 is stretched over plural (four in this exemplary embodiment) tension rolls 31 to 34. For example, the tension roll 31 is used as a drive roll, which is driven by a drive motor (not shown), to circulate the intermediate transfer body 30. Further, the tension rolls 32 to 34 are all used as driven rolls, and the tension roll 33 functions as a tension roll that applies a predetermined tension to the intermediate transfer body 30. Furthermore, an intermediate transfer body cleaning device 35 for removing a residual toner on the intermediate transfer body 30 after the secondary transfer is provided on a portion of the peripheral surface of the intermediate transfer body 30 facing the tension roll 31.

Secondary Transfer Device (Collective Transfer Device)

Further, in the secondary transfer device (collective transfer device) 40, a transfer roll 41 is disposed in a portion of the periphery of the intermediate transfer body 30 facing the tension roll 34 so as to be in contact with the surface of the intermediate transfer body 30, and a predetermined transfer electric field is applied between the transfer roll 41 and the tension roll 34 using the tension roll 34 as a counter electrode.

In this exemplary embodiment, the transfer roll 41 has a configuration in which a metal shaft is covered with an elastic layer in which carbon black or the like is blended with foamed urethane rubber or EPDM, and while a metal shaft is installed, a predetermined transfer voltage is applied to the tension roll 34 that is a counter electrode.

Fixing Device

The fixing device 50 includes a heat fixing roll 51 that is rotatably disposed in contact with the paper S on the image holding surface side, and a pressure fixing roll 52 that is press-contact with the heat fixing roll 51 and rotates following the heat fixing roll 51, in which the image held on the paper S is passed through the transfer region between the two fixing rolls 51 and 52 to heat, press, and fix the image.

Configuration Example of Photoconductor

Figure 3A:
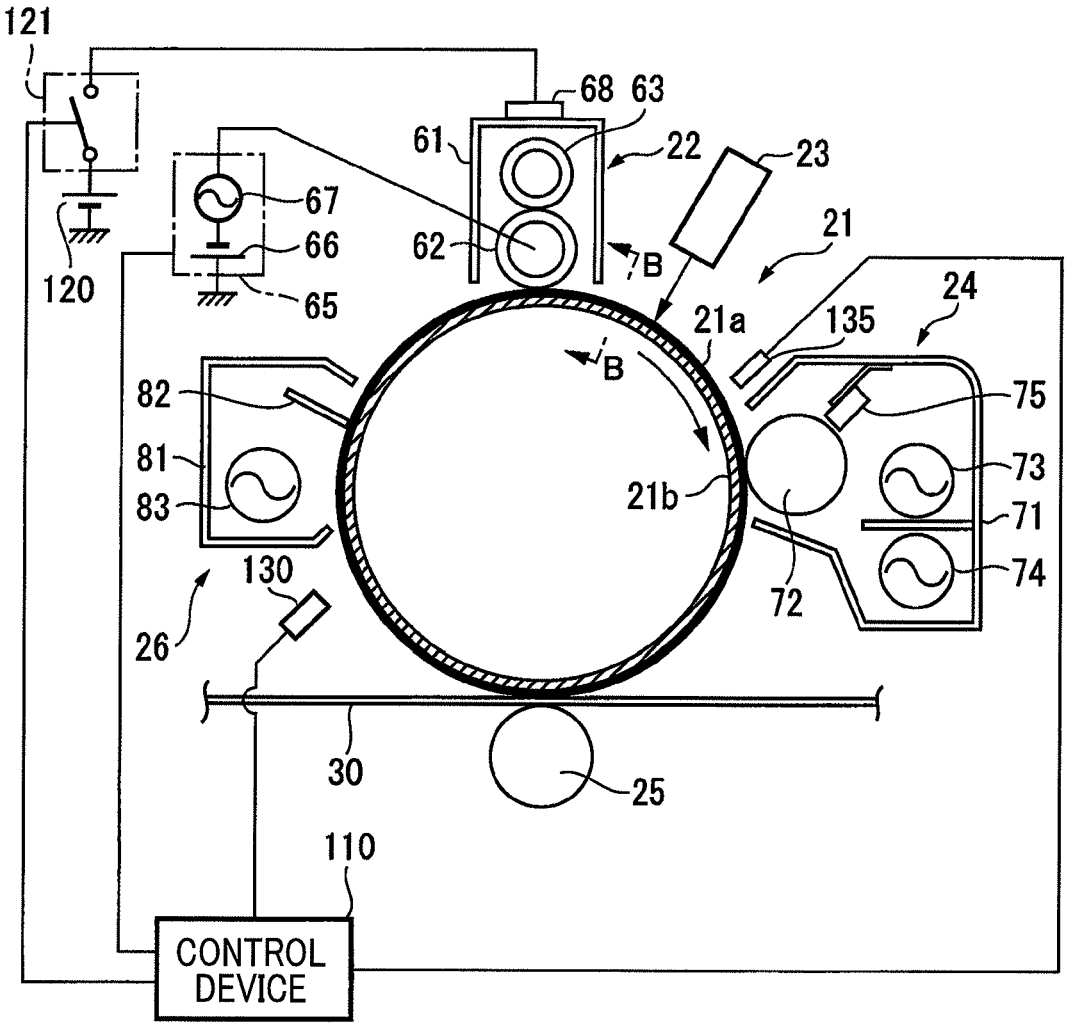
FIG. 3A is an explanatory diagram illustrating a configuration example of each image forming portion illustrated in FIG. 2.
Figure 3B:
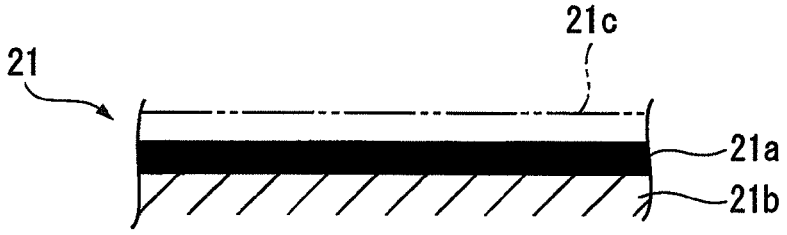
FIG. 3B is a sectional explanatory diagram taken along line B-B in FIG. 3A.

In the exemplary embodiment, as illustrated in FIGS. 3A and 3B, for example, the photoconductor 21 having a photosensitive layer 21*a* on the surface of a drum-shaped base body 21*b* is used. In this exemplary embodiment, the photosensitive layer 21*a* is formed of an organic material such as an organic photosensitive material, and may be a function separation type that is divided into a charge generation layer and a charge transport layer, or may be a function integration type.

This type of photosensitive layer 21*a* may be exposed and used as it is on the surface layer of the photoconductor 21, but is easily worn, and therefore, a protective layer 21*c* may be provided on the photosensitive layer 21*a* as indicated by a virtual line in FIG. 3B.

The photoconductor 21 may be provided with an undercoat layer (not shown) between the base body 21*b* and the photosensitive layer 21*a* as necessary. Of course, the design may be changed as appropriate, such as providing other functional layers between the photosensitive layer 21*a* and the protective layer 21*c*.

Here, the protective layer 21*c* is provided, for example, for the purpose of preventing scratches on the surface of the photoconductor 21, preventing variations in polishing, preventing adsorption of nitride oxide, or the like, improving resistance to an oxidizing atmosphere by ozone or nitride oxide, and the like. The protective layer 21*c* may be a film that is highly transparent, dense, and excellent in hardness.

Configuration Example of Charging Device

In the exemplary embodiment, as illustrated in FIG. 3A, the charging device 22 includes a charging housing 61 as a housing having a substantially U-shaped cross section that opens at a portion facing the photoconductor 21, and provided with a charging roll 62 as a charging unit that contacts the surface of the photoconductor 21 in the charging housing 61, and a cleaning roll 63 as a cleaning unit that cleans the charging roll 62.

Here, the charging roll 62 has, for example, a conductive metal shaft, and a charging layer is formed at a portion except for the support portions at both ends of this shaft; however, this exemplary embodiment is not limited to this, and the design may be changed as appropriate.

On the other hand, the cleaning roll 63 has, for example, a conductive metal shaft, and a sponge layer is formed by, for example, spirally winding a sponge material as a cleaning material around the shaft. This type of sponge layer is selected from those made of foamable resin or rubber such as polyurethane, polyethylene, polyamide, or polypropylene. Note that, the configuration of the cleaning roll 63 is not limited to this, and the design may be changed as appropriate.

In this exemplary embodiment, the cleaning roll 63 is pressed against the charging roll 62 with a predetermined load, and the sponge layer is elastically deformed along the peripheral surface of the charging roll 62 to form a contact area. When the photoconductor 21 is rotationally driven by a drive motor (not shown), the charging roll 62 is driven to rotate by the rotation of the photoconductor 21, and the cleaning roll 63 is driven to rotate by the rotation of the charging roll 62.

As described above, when the cleaning roll 63 is driven to rotate, foreign matters such as toner and external additives attached to the surface of the charging roll 62 are cleaned by the cleaning roll 63.

Further, in this exemplary embodiment, a charging power supply 65 is connected to the charging roll 62 as illustrated in FIG. 3A. The charging power supply 65 is formed by connecting a DC power supply 66 and an AC power supply 67 in series, and both the power supplies 66 and 67 are configured to be variably adjustable. For this reason, a charging voltage Vc in which an AC component is superimposed on a DC component is applied to the charging roll 62.

Furthermore, in this exemplary embodiment, a charging heater 68 is provided as a heating unit that heats the charging housing 61 and the charging roll 62. Note that, the details of the charging heater 68 will be described later.

Configuration Example of Developing Machine

The developing machine 24 includes a developing container 71 in which a portion facing the photoconductor 21 is opened and a developer containing, for example, a toner and a carrier is stored, and provided with a developing roll 72 capable of holding the developer at a portion facing the opening of the developing container 71, stirring and transporting members 73 and 74 in which the developer is stirred to be circulated and transported on the back side of the developing roll 72 of the developing container 71, and a layer thickness regulating member 75 that regulates the layer thickness of the developer that can be held on the developing roll 72 at a portion facing the developing roll 72.

In this exemplary embodiment, a developing power supply (not shown) is connected to the developing roll 72. The developing power supply is formed, for example, by connecting a DC power supply and an AC power supply in series, and both the power supplies are configured to be variably adjustable. For this reason, a developing voltage in which an AC component is superimposed on a DC component is applied to the developing roll 72.

Configuration Example of Cleaning Device

As illustrated in FIG. 3A, the cleaning device 26 includes a cleaning container 81 having an opening at a portion facing the photoconductor 21, and provided with a plate-shaped clean member 82 that is elastically in contact with the photoconductor 21 at a portion facing the opening along the longitudinal direction of the cleaning container 81, and a transport member 83 that transports residues such as toner scraped off by the clean member 82 along the longitudinal direction of the cleaning container 81 and outputs the residues to the outside in the cleaning container 81.

Heating Mechanism with Charging Heater

Figure 4A:
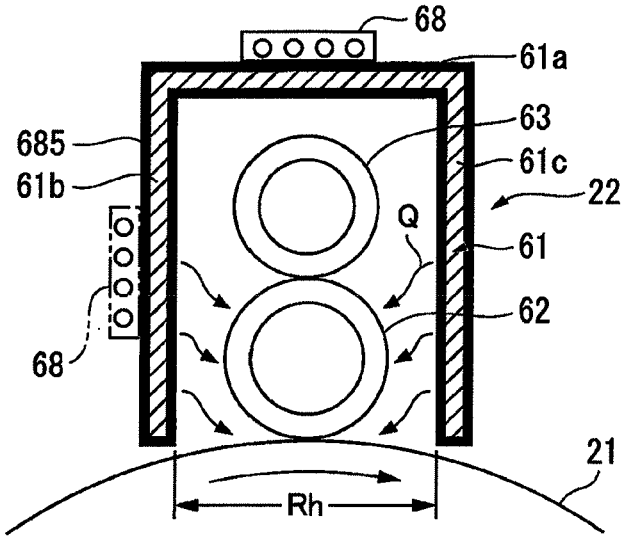
FIG. 4A is an explanatory diagram illustrating a major part of the charging device illustrated in FIG. 3A.

In this exemplary embodiment, as illustrated in FIGS. 3A and 4A, the charging heater 68 is disposed in contact with the outer surface of a back surface portion 61*a* facing the opening of the charging housing 61 in the charging housing 61 having a substantially U-shaped cross section.

Figure 4B:
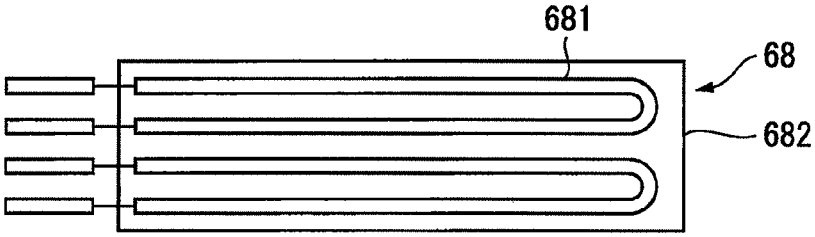
FIG. 4B is an explanatory diagram illustrating a configuration example of a charging heater used in FIG. 4A.

As illustrated in FIG. 4B, the charging heater 68 includes, for example, an electric heating resistance wire 681 attached to a flat sheet 682 so that the surface in contact with the heating target can be substantially uniformly heated. However, the charging heater 68 is not limited to this and may be any of various flat heaters such as a silicon rubber heater, a flat thin plate space heater, and a polyimide flat heater. As a matter of course, the charging heater 68 may be other than the flat heater.

In particular, in this exemplary embodiment, the outer surface and the inner surface of the charging housing 61 are covered with a thermally conductive member 685 made of copper having a higher heat conduction coefficient than the charging housing 61, and the charging heater 68 is disposed on the outer surface of the covered thermally conductive member 685. Therefore, in this exemplary embodiment, the heat from the charging heater 68 heats the charging housing 61 via the thermally conductive member 685, and further, the surface of the photoconductor 21 is heated by radiant heat Q from the charging housing 61 in a region Rh facing the openings of the charging roll 62 and the charging housing 61.

Figure 4C:
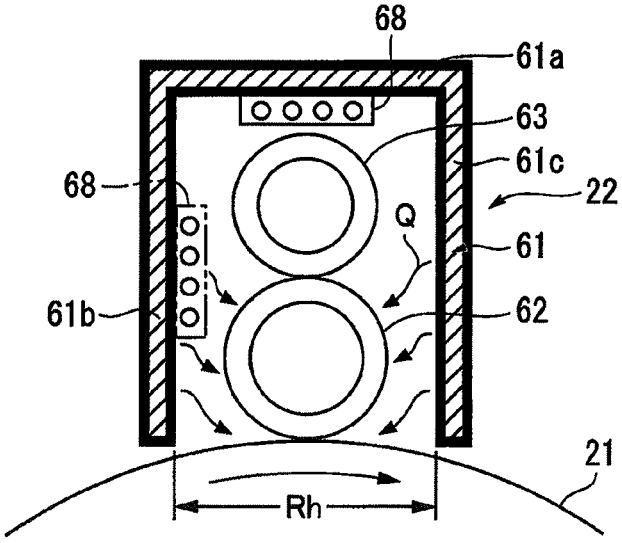
FIG. 4C is an explanatory diagram illustrating a modification exemplary embodiment of the charging device illustrated in FIG. 4A.

In addition, the installation location of the charging heater 68 is not limited to the position indicated by a solid line in FIG. 4A. For example, as indicated by a virtual line in FIG. 4A, it may be disposed in contact with the outer surface of a side surface portion 61*b* (or 61*c*) of the charging housing 61 which is adjacent to the opening of the charging housing 61. Furthermore, the installation location of the charging heater 68 is not limited to the outside of the charging housing 61, as indicated by the solid line in FIG. 4C, the charging heater 68 may be disposed in contact with the inner surface of the back surface portion 61*a* of the charging housing 61 which faces the opening of the charging housing 61. Alternatively, as indicated by the virtual line in FIG. 4C, the charging heater 68 may be disposed in contact with the inner surface of the side surface portion 61*b* (or 61*c*) of the charging housing 61 which is adjacent to the opening of the charging housing 61. Note that, as compared with the case of disposing the charging heater 68 in contact with the outer surface of the charging housing 61 as indicated by the solid line or virtual line in FIG. 4A, when the charging heater 68 is disposed in contact with the inner surface of the charging housing 61 as indicated by the solid line or virtual line in FIG. 4C, the charging roll 62 can be efficiently heated.

Necessity of Installing a Charging Heater

Figure 5A:
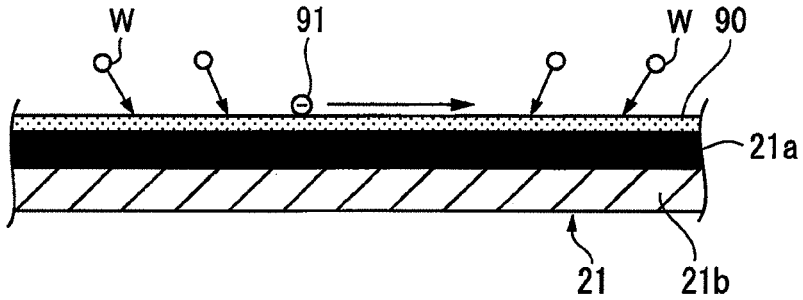
FIG. 5A is an explanatory diagram illustrating a technical background in which the charging device used in the first exemplary embodiment is employed.

As illustrated in FIG. 5A, in general, in the charging area between the charging roll 62 and the photoconductor 21 of the charging device 22, discharge due to charging voltage application occurs, and as a result, a discharge product 90 such as ozone or nitrogen oxide is generated and attached to the surface of the photoconductor 21.

At this time, for example, in a high humidity environment, since there is a lot of moisture W in the environment surrounding the photoconductor 21, the opportunity for the moisture W to be attached to the surface of the photoconductor 21 is increased. In this state, since the discharge product 90 has water absorbency, it is assumed that when the moisture W is absorbed, it is ionized like electrolytic water, and as a result, a charged electric charge 91 on the surface of the photoconductor 21 is conducted along the surface of the surface of the photoconductor 21, which may lead to an image defect that causes image flow.

Therefore, in this exemplary embodiment, in order to prevent this type of image defect, as a countermeasure that the moisture W is not absorbed by the discharge product 90 generated in the charging area between the charging roll 62 and the photoconductor 21, it is intended to remove the moisture W in the vicinity of the charging area by locally heating the charging roll 62 and the photoconductor 21 opposed thereto. Further, it is intended to reduce the amount of discharge product 90 by reducing the amount of current required for charging by heating the charging roll 62.

Points to Note when Selecting Charging Current

Figure 5B:
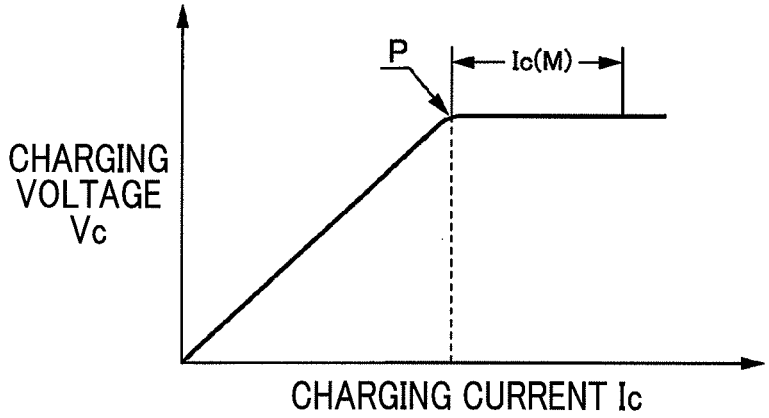
FIG. 5B is a schematic explanatory diagram illustrating a relationship between a charging voltage Vc applied to the charging device and a charging current Ic.

In this exemplary embodiment, when examining the relationship between the charging voltage Vc of the charging device 22 and the charging current Ic, as illustrated in FIG. 5B, the charging voltage Vc is increased in proportion to an increase in the charging current Ic; however, when the charging voltage Vc reaches a predetermined peak value, no increase in the charging voltage Vc is observed even if the charging current Ic increases thereafter. Therefore, when using a stable charging voltage Vc, a predetermined peak value is employed as the charging voltage Vc. Immediately after the charging voltage Vc reaches a predetermined peak value, an abnormal discharge occurs and a white spot occurs, and thus it is necessary to select the charging current Ic by taking a predetermined margin (Ic (M): %) from a boundary point P at which the charging voltage Vc reaches the predetermined peak value. On the other hand, if the margin Ic (M) of the charging current Ic is excessively large, a large amount of discharge product 90 may be produced. Thus, the margin Ic (M) of the charging current Ic should be reduced as much as possible. Therefore, it is necessary to obtain a margin Ic (M) of the charging current Ic that prevents the generation of the discharge product 90 while preventing the white spot. Here, it has been clarified by the inventors that when the charging roll 62 is heated to a high temperature, a white spot does not occur even if the margin Ic (M) of the charging current Ic is small. Therefore, in order to obtain the optimum margin Ic (M) of the charging current Ic, it is important to take the temperature of the charging roll 62 into consideration, and as described above, it is necessary to heat the charging roll 62 by installing the charging heater 68.

Restriction of Heating Operation by Charging Heater

Figure 5C:
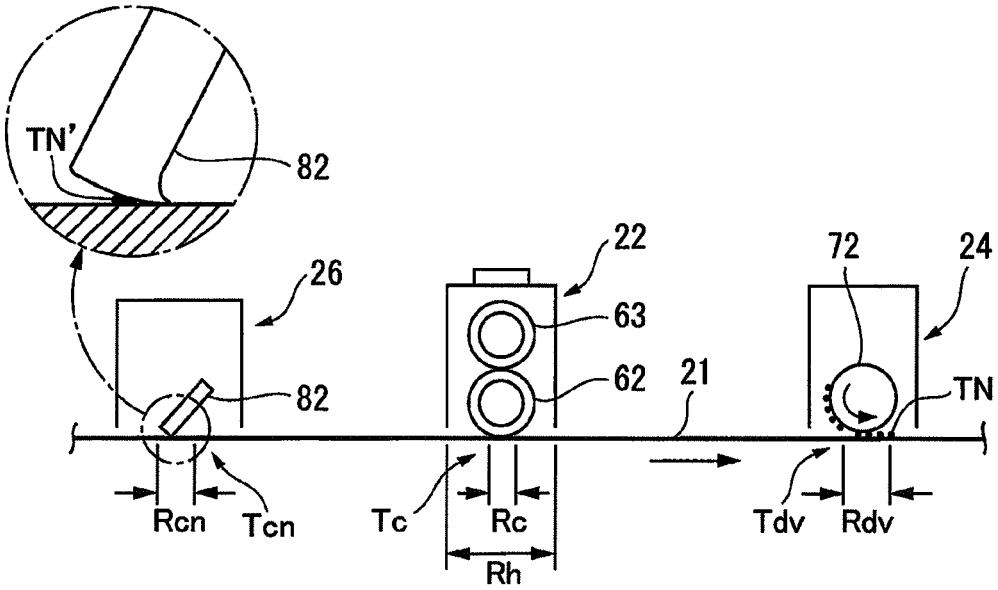
FIG. 5C is an explanatory diagram illustrating temperature conditions necessary in a charging area of the charging device, a developing area of a developing machine, and a cleaning area of a cleaning device.

In the exemplary embodiment, as illustrated in FIG. 5C, a developing machine 24 is installed around the photoconductor 21 downstream of the charging device 22 in the rotational direction of the photoconductor 21, and a cleaning device 26 is installed upstream of the charging device 22 in the rotational direction of the photoconductor 21.

Here, in a developing area Rdv of the developing machine 24, a developing operation is performed in which the electrostatic latent image formed on the photoconductor 21 is developed by a toner TN of the developer held on the developing roll 72. At this time, a surface temperature Tdv of the photoconductor 21 facing the developing area Rdv needs to be at least lower than a toner heat resistance limit temperature Ttn. For this reason, the heating operation by the charging heater 68 of the charging device 22 heats the photoconductor 21 in the region Rh facing the opening of the charging roll 62 and the charging housing 61, but the surface temperature of the photoconductor 21 should be within a range that is lower than the toner heat resistance limit temperature Ttn at the stage where the surface temperature reaches the developing area Rdv. In FIGS. 5A to 5C, Tc represents the surface temperature of the charging roll 62, and Rc represents the charging area by the charging roll 62.

The term of "toner heat resistance limit temperature Ttn" in this exemplary embodiment means, for example, the softening point of the toner. As a method for measuring the softening point of the toner, for example, ½ descent rate (temperature corresponding to ½ of the height from the outflow start point to the end point when the toner sample is melted out) which is measured under the conditions of a die pore diameter of 0.5 [mm], a pressure load of 0.98 [MPa], and a rate of temperature increase of 1 [° C./Min] by using a flow tester: CFT500 (manufactured by Shimadzu Corporation) may be used as the softening point of the toner.

The surface temperature Tcn of the photoconductor 21 facing an area Rcn to be cleaned by the clean member 82 of the cleaning device 26 may be such that a residual toner TN' removed by the clean member 82 is prevented from melting and staying in the vicinity of the cleaning area Rcn between the clean member 82 and the photoconductor 21. If the residual toner TN' is melted and stayed at the tip end portion of the clean member 82, there is a concern in that the contact pressure of the clean member 82 is excessively applied to the rotational drive of the photoconductor 21, and the rotational torque of the photoconductor 21 is unnecessarily bulky. In this exemplary embodiment, an allowable range is determined in advance as the rotational torque of the photoconductor 21, the surface temperature Tcn of the photoconductor 21 corresponding to the maximum value of the allowable range is set as a torque guarantee temperature Ttq, and the surface temperature Tcn of the photoconductor 21 in the cleaning area Rcn is set to be equal to or lower than the torque guarantee temperature Ttq.

Heating Conditions with Charging Heater

In selecting the heating conditions of the charging heater 68, some conditions for reducing the margin Ic (M) of the charging current Ic will be examined.

The following four boundary lines are listed as consideration items.

I: Allowable line between surface temperature change of charging roll capable of reducing white spot and margin Ic (M) of charging current Ic II: Allowable line between surface temperature change of charging roll and image flow III: Toner heat resistance tolerance line (corresponding to toner heat resistance limit temperature Ttn)

IV: Allowable line between surface temperature of charging roll and margin Ic (M) of charging current Ic for obtaining the allowable rotational torque When the heating condition of the charging heater 68 is selected in consideration of these four boundary lines, the result illustrated in FIG. 6 is obtained.

Figure 6:
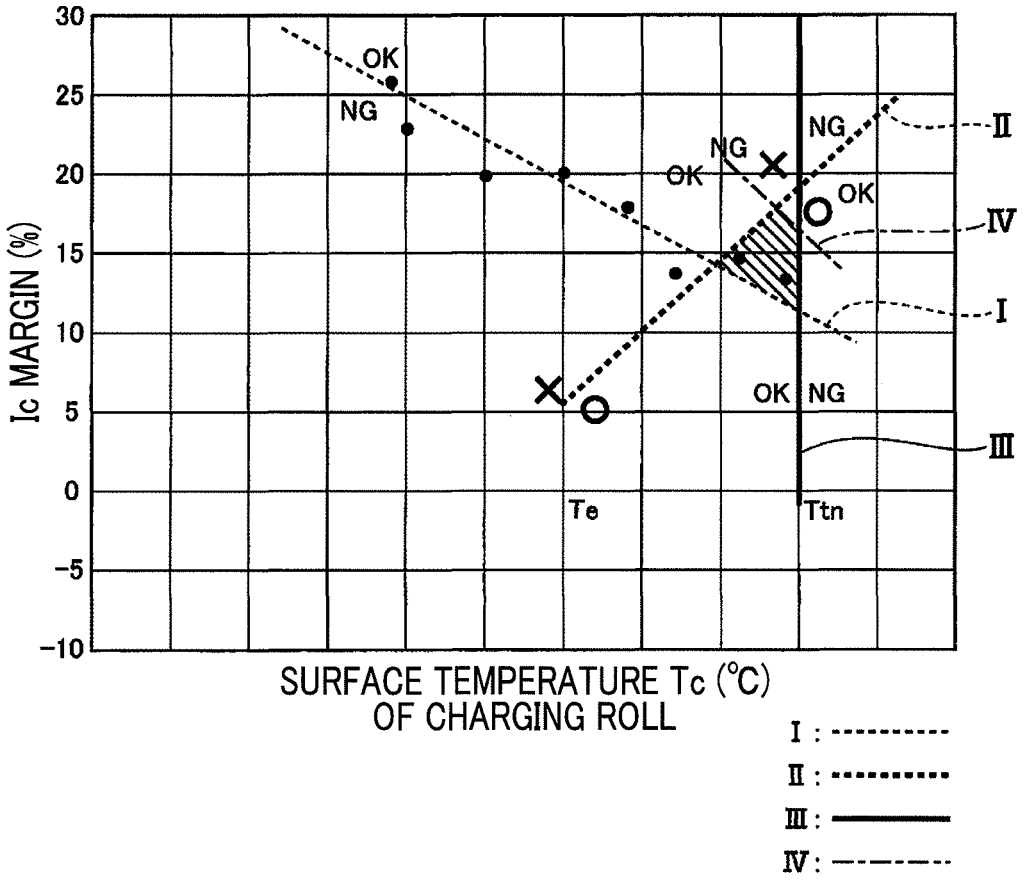
FIG. 6 is an explanatory diagram illustrating an example of setting a margin of the charging current Ic of the charging device employed in the first exemplary embodiment.

In FIG. 6, if the environmental temperature at which the charging heater 68 starts to be used is set as Te, regarding the boundary line I, it is suggested that when the surface temperature Tc of the charging roll 62 when the charging heater 68 is not used is set to be less than Te, the lower the surface temperature Tc of the charging roll 62, the larger the margin Ic (M) of the charging current Ic needs to be secured, and when the surface temperature Tc of the charging roll 62 is increased with heating by the charging heater 68, the margin Ic (M) of the charging current Ic may be small, and the margin Ic (M) of the charging current Ic is reduced with the heating of the charging heater 68.

In addition, regarding the boundary line II, it is suggested that when the surface temperature Tc of the charging roll 62 is increased with the heating by the charging heater 68, the margin Ic (M) of the charging current Ic for preventing image flow, for example, in 10*k* image forming cycles, tends to be proportionally increased, and the range of use may be set to be equal to or lower than the boundary line II.

Further, it is suggested that the boundary line III needs to be selected so that the surface temperature of the charging roll 62 does not exceed the toner heat resistance boundary so as to be within the toner heat resistance limit temperature Ttn.

Furthermore, regarding the boundary line IV, when the surface temperature Tc of the charging roll 62 is increased with heating by the charging heater 68, it is necessary to use a smaller margin Ic (M) of the charging current Ic, and if a large margin Ic (M) of the charging current Ic is used, there is a concern in that the torque allowable line may be exceeded.

From the above examination results, as illustrated in FIG. 6, it is suggested that the surface temperature Tc of the charging roll 62 and the margin Ic (M) of the charging current Ic in the region (indicated by a dashed line in FIG. 6) surrounded as an OK region of each of the boundary lines I to IV are selected as the heating conditions for the charging roll 62.

System for Controlling Photoconductor Heating Control Sequence

As illustrated in FIGS. 3A and 3B, the system for controlling the sequence for controlling the heating of the photoconductor 21 is as follows. For example, it has a control device 110 provided with a microcomputer including a CPU, a RAM, a ROM, and an input/output port, and a program for controlling the sequence for heating the photoconductor 21 (refer to FIG. 7) is installed in the ROM of the control device 110 in advance so that the CPU executes the program and sends a control signal to the charging heater 68 of the charging device 22.

In particular, in this exemplary embodiment, a heating power supply 120 is connected to the charging heater 68 via a switch 121, and the switch 121 is turned on and off by a control signal from the control device 110.

In addition, an environment sensor 130 is installed in the vicinity of the periphery of the photoconductor 21 so that the sequence for controlling the heating of the photoconductor 21 is selectively performed according to the environment surrounding the photoconductor 21. Here, the environment sensor 130 may be one that detects both temperature and humidity, or may be one that detects at least humidity.

Further, a temperature sensor 135 for detecting the surface temperature of the photoconductor 21 is installed in a region between the charging device 22 and the developing machine 24 downstream of the charging device 22 in the rotational direction of the photoconductor 21 in the periphery of the photoconductor 21.

Action of Image Forming Apparatus

Image Forming Sequence

In the exemplary embodiment, in a case where the image forming apparatus is operated, a start switch (not shown) may be turned on, and as illustrated in FIG. 2, each color component image is formed in each image forming portion 20 (20*a* to 20*d*), and the image formed in each image forming portion 20 is transferred to the intermediate transfer body 30 and then transferred to the paper S in the secondary transfer area by the secondary transfer device 40. The paper S on which the image has been transferred is discharged from an output potion (not shown) through a fixing process by the fixing device 50.

Photoconductor Heating Control Sequence

Next, the sequence for controlling the heating of the photoconductor 21 will be described.

Figure 7:
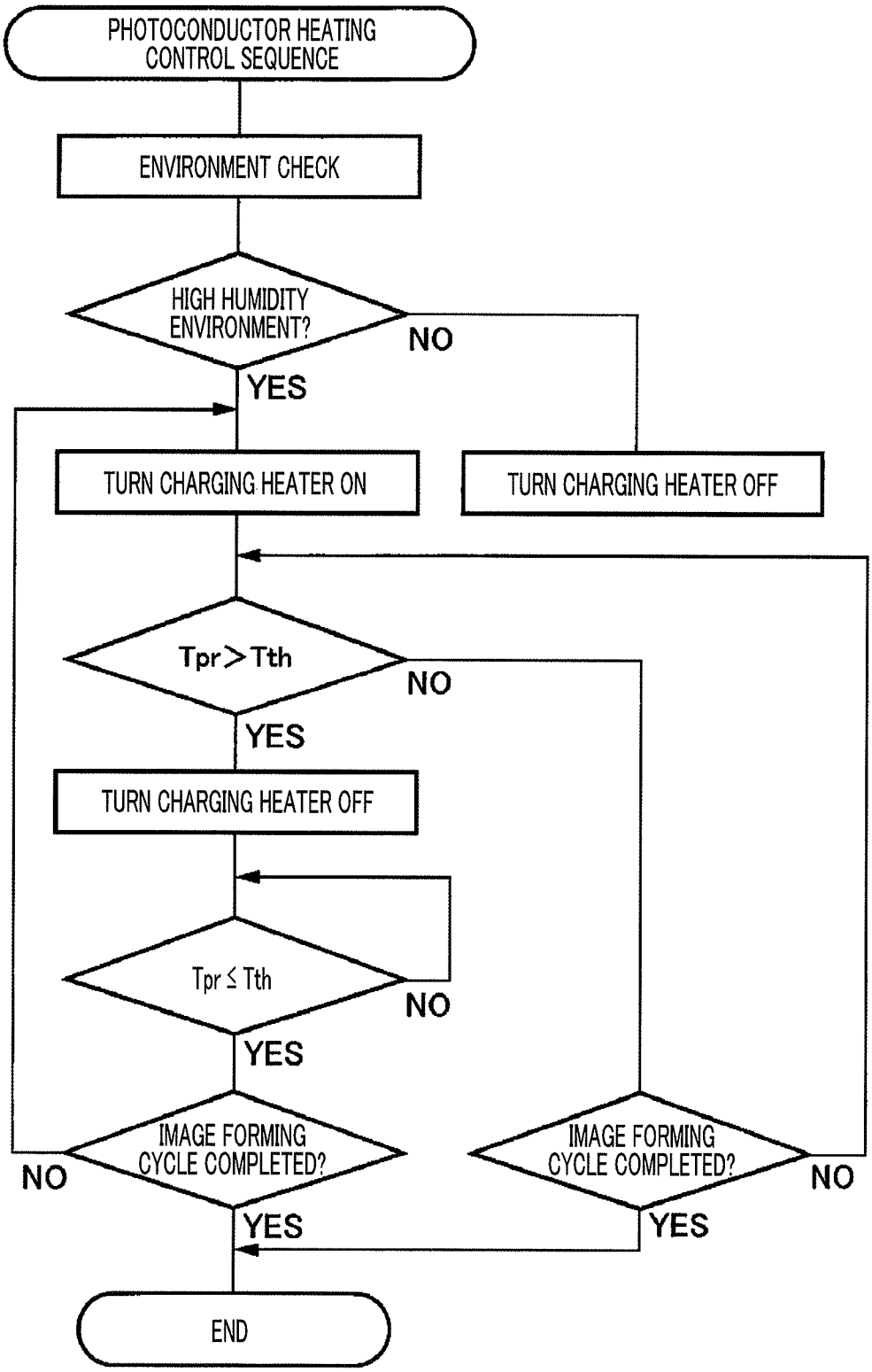
FIG. 7 is a flowchart illustrating a photoconductor heating control sequence used in the image forming apparatus according to the first exemplary embodiment.

As illustrated in FIGS. 3A and 7, the control device 110 performs the sequence for controlling the heating of the photoconductor 21 in parallel with the image forming sequence.

In this exemplary embodiment, the control device 110 performs an environment check. This environment check detects environmental information (temperature and humidity in this exemplary embodiment) of the environment sensor 130 and determines whether or not the environment surrounding the photoconductor 21 is a high humidity environment. The term of "high humidity environment" here means, for example, a high temperature and high humidity environment where the temperature is 28° C. or higher and the humidity is 85% or higher.

When it is determined that the environment surrounding the photoconductor 21 is the high humidity environment, the control device 110 supplies the heating voltage from the heating power supply 120 to the charging heater 68 by turning on the switch 121. Then, the charging heater 68 is turned on.

In addition, the control device 110 monitors the temperature information detected from the temperature sensor 135, when the surface temperature of the photoconductor 21 is set as Tpr and the target temperature of the photoconductor 21 is set as Tth (in this exemplary embodiment, for example, a temperature set slightly lower than the toner heat resistance limit temperature Ttn and the torque guarantee temperature Ttq), until the image forming cycle is completed, turning on/off of the charging heater 68 is controlled so that the surface temperature Tpr of the photoconductor 21 is maintained at the target temperature Tth.

In this way, when the sequence for controlling the heating of the charging heater 68 is performed, the heat from the charging heater 68 heats the charging housing 61 via the thermally conductive member 685, and in the charging housing 61, radiant heat from the charging housing 61 heats the charging roll 62, and the surface of the photoconductor 21 facing the opening of the charging housing 61 is heated. For this reason, discharge is performed in the charging area Rc between the charging roll 62 and the photoconductor 21, as illustrated in FIG. 5A, the moisture W around the photoconductor 21 is evaporated and removed by heating the charging roll 62 and the photoconductor 21, and as a result, the moisture W is prevented from being absorbed by the discharge product 90 on the photoconductor 21. In this state, since the discharge product 90 on the photoconductor 21 does not become a state like electrolyzed water, it is difficult for the charged electric charge 91 to be conducted along the surface of the photoconductor 21, and image quality defects such as image flow can be prevented.

In this exemplary embodiment, since the charging roll 62 and the surface of the photoconductor 21 are heated by the charging heater 68, as illustrated in FIG. 6, the margin Ic (M) of the charging current Ic applied to the charging roll 62 can be reduced to be small.

Furthermore, in this exemplary embodiment, since the surface temperature Tpr of the photoconductor 21 is adjusted to the target temperature Tth, the surface temperature Tpr of the photoconductor 21 does not exceed the toner heat resistance limit temperature Ttn and the torque guarantee temperature Ttq, and the developing performance with toner of the developing machine 24 is impaired. Alternatively, there is no concern in that excessive torque is generated in the photoconductor 21 at the contact portion with the clean member 82 in the cleaning device 26.

If it is determined that the environment surrounding the photoconductor 21 is not the high humidity environment, the charging heater 68 is kept off. In this case, the sequence for controlling the heating of the photoconductor 21 is not performed when the environment surrounding the photoconductor 21 is not a high humidity environment. This is because, as compared with the case where the environment surrounding the photoconductor 21 is a high humidity environment, it is less necessary to perform the sequence for controlling the heating of the photoconductor 21. That is, the fact that the environment surrounding the photoconductor 21 is not a high humidity environment means that the humidity around the photoconductor 21 is small. In this situation, in the charging area of the charging device 22, as illustrated in FIG. 5A, the moisture W is hardly attached to the discharge product 90 on the photoconductor 21, so that the charged electric charge 91 on the photoconductor 21 is conducted along the surface of the photoconductor 21 and rarely cause image flow.

Modification Exemplary Embodiment 1-1

In this exemplary embodiment, a method of selectively performing the sequence for controlling the heating of the photoconductor 21 according to the environment surrounding the photoconductor 21 is employed; however, the exemplary embodiment is not limited to this, and it goes without saying that the sequence for controlling the heating of the photoconductor 21 may be performed periodically or irregularly regardless of the environment surrounding the photoconductor 21.

First Comparative Exemplary Embodiment

Figure 8:
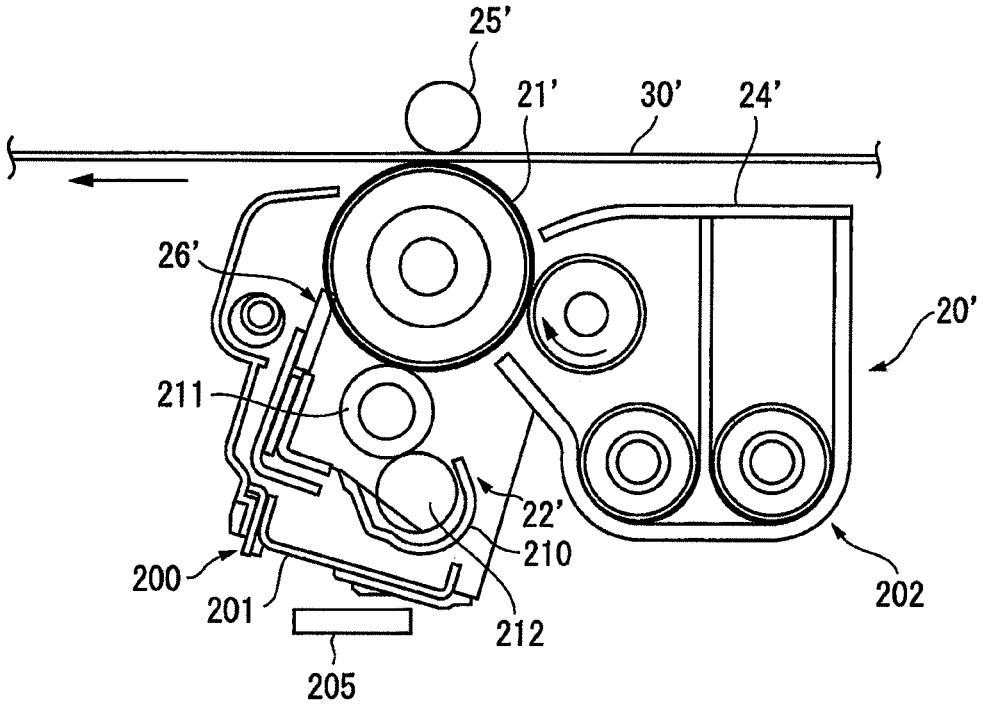
FIG. 8 is an explanatory diagram illustrating a configuration example of an image forming portion according to a first comparative exemplary embodiment.

FIG. 8 illustrates a configuration example of the image forming portion of the image forming apparatus according to the first comparative exemplary embodiment.

In FIG. 8, the basic configuration of the image forming apparatus is that plural (for example, four) image forming portions 20' are installed below the intermediate transfer body 30', and as the image forming portion 20', a charging device 22' (charging housing 210, charging roll 211, and cleaning roll 212), a developing machine 24', and a cleaning device 26' are arranged in the vicinity of a drum-shaped photoconductor 21'. In this exemplary embodiment, the photoconductor 21', the charging device 22', and the cleaning device 26' are housed in a cartridge case 201 as a photosensitive cartridge 200, while the developing machine 24' is configured as a developing cartridge 202 separately from the photosensitive cartridge 200. Reference numeral 25' denotes a primary transfer device.

In this exemplary embodiment, a photosensitive peripheral heater 205 is disposed outside the photosensitive cartridge 200 of the image forming portion 20'. For example, the space in the vicinity of the image forming portion 20' is heated by turning on the photosensitive peripheral heater 205 when the image forming apparatus is not operated in the high humidity environment.

In this exemplary embodiment, the photosensitive peripheral heater 205 is intended to remove moisture in the vicinity of the image forming portion 20' in the high humidity environment. In the photosensitive cartridge 200, the photosensitive peripheral heater 205 is installed on the back surface side of the charging device 22' when viewed from the photoconductor 21', and a cartridge case 201 is provided outside the charging housing 210 of the charging device 22', and the heat from the photosensitive peripheral heater 205 is shielded by the cartridge case 201.

For this reason, the "photosensitive peripheral heater 205" according to the first comparative exemplary embodiment does not have an action of directly heating the charging housing 210 or the charging roll 211 of the charging device 22' unlike the "charging heater 68" according to the first exemplary embodiment, and it cannot be said that the moisture is removed in the charging area between the charging roll 211 and the photoconductor 21'.

Second Exemplary Embodiment

Figure 9:
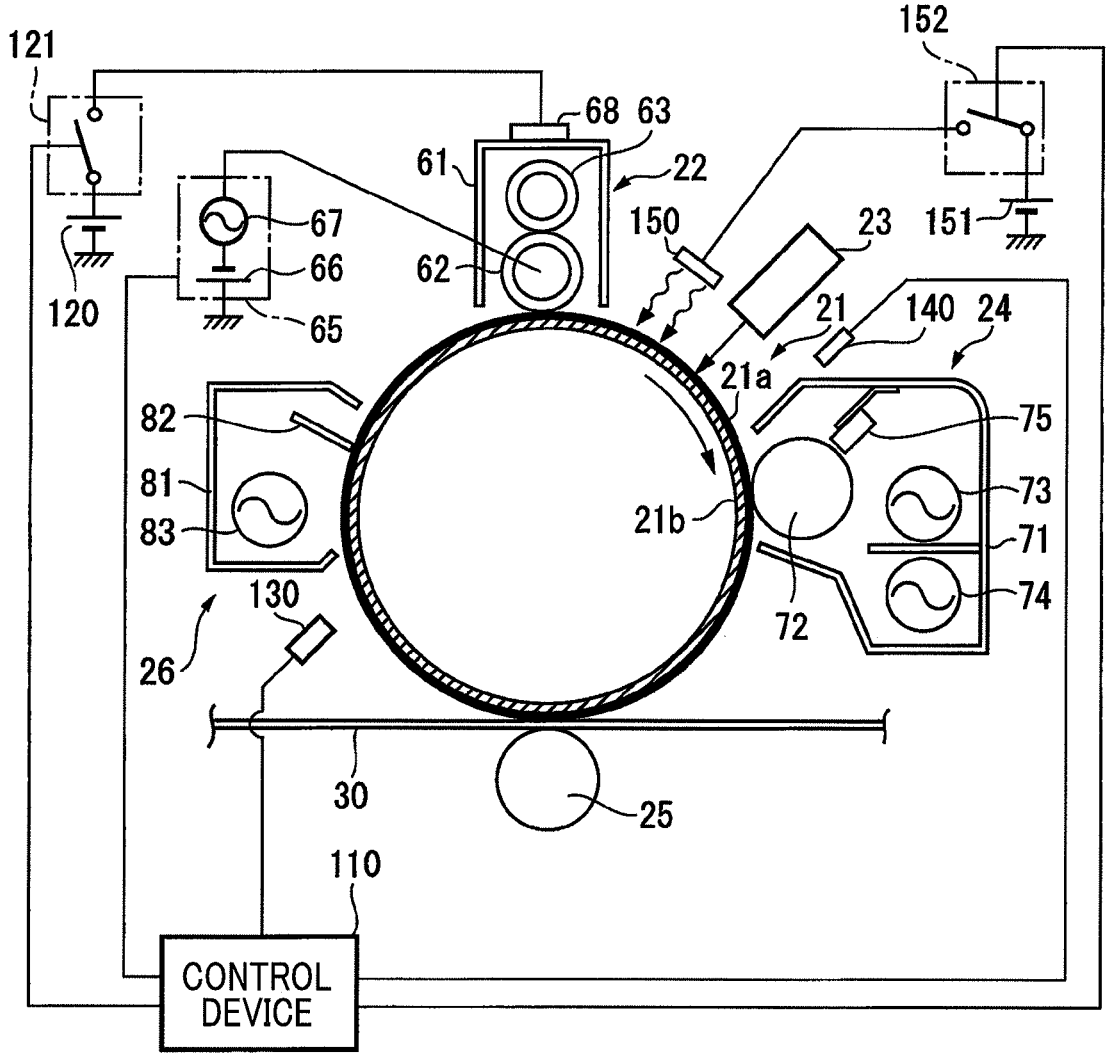
FIG. 9 is an explanatory diagram illustrating major parts around an image forming portion of an image forming apparatus according to a second exemplary embodiment.

FIG. 9 illustrates the major parts of the image forming portion of the image forming apparatus according to a second exemplary embodiment.

In FIG. 9, the basic configuration of the image forming portion 20 is substantially the same as that of the first exemplary embodiment, but unlike the first exemplary embodiment, in the vicinity of the photoconductor 21, a photoconductor heater 150 for heating the surface of the photoconductor 21 is installed between the charging device 22 and the developing machine 24 downstream of the charging device 22 in the rotational direction of the photoconductor 21. Note that, components similar to those in the first exemplary embodiment are denoted by the same reference numerals as those in the first exemplary embodiment, and detailed description thereof will not be repeated here.

In this exemplary embodiment, the photoconductor heater 150 is disposed, for example, in a non-contact manner so as to face the surface of the photoconductor 21, and directly heats the surface of the photoconductor 21. In addition, a heating power supply 151 is connected to the photoconductor heater 150 via a switch 152, and the switch 152 is turned on and off by a control signal from the control device 110.

Note that, as the photoconductor heater 150, it is also possible to use one that is disposed in the vicinity of the photoconductor 21 and indirectly heats the photoconductor 21 by heating the peripheral space of the photoconductor 21.

In addition, in this exemplary embodiment, a humidity sensor that detects only humidity information is used as the environment sensor 130. In the periphery of the photoconductor 21, a temperature sensor 140 for detecting the temperature of the peripheral space of the photoconductor 21 is separately installed in a region between the charging device 22 and the developing machine 24 downstream of the charging device 22 in the rotational direction of the photoconductor 21. Note that, in this exemplary embodiment, the temperature sensor 140 is provided separately from the environment sensor 130 for detecting information on the environment surrounding the photoconductor 21. However, the temperature sensor 140 may also be used in consideration of the installation location of the environment sensor 130.

Figure 10:
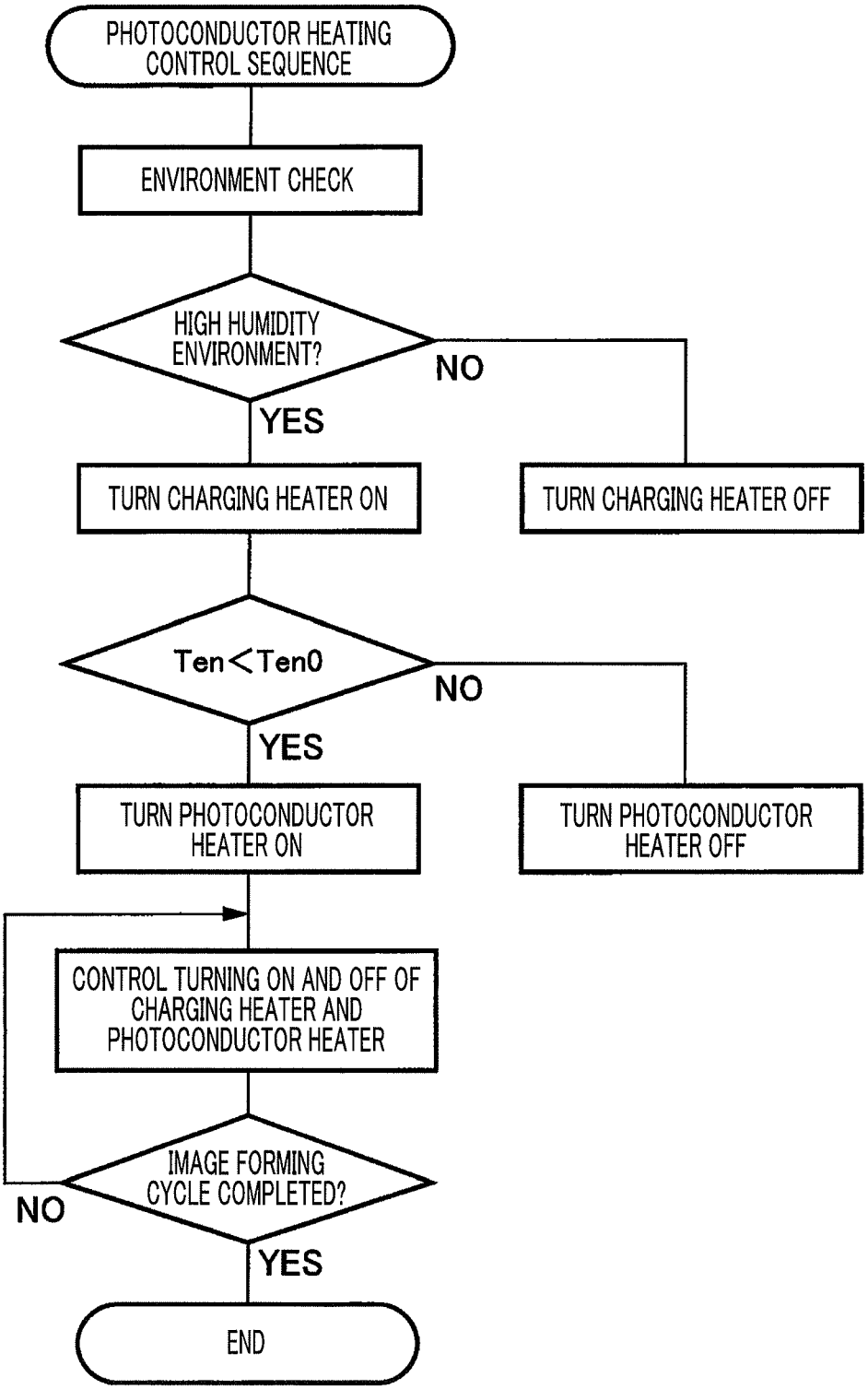
FIG. 10 is a flowchart illustrating a photoconductor heating control sequence used in the image forming apparatus according to the second exemplary embodiment.

According to the exemplary embodiment, the control device 110 first performs an environment check as illustrated in FIG. 10. This environment check detects environmental information (humidity in this exemplary embodiment) of the environment sensor 130 and determines whether or not the environment surrounding the photoconductor 21 is a high humidity environment. The term of "high humidity environment" here means, for example, a high humidity environment where the humidity is 85% or higher.

When the control device 110 determines that the environment surrounding the photoconductor 21 is a high humidity environment, the charging heater 68 is turned on, and when the control device 110 determines that the environment surrounding the photoconductor 21 is not a high humidity environment, the charging heater 68 is kept off.

After that, the control device 110 compares a detection temperature Ten with a predetermined reference temperature Ten0 based on the temperature information detected by the temperature sensor 140. When Ten<Ten0 is established, the photoconductor heater 150 is turned on, and when Ten≤Ten0, the photoconductor heater 150 is kept off.

Thereafter, the control device 110 performs on/off control of the charging heater 68 and the photoconductor heater 150 so as to maintain the respective target temperatures until the image forming cycle is completed.

As described above, in this exemplary embodiment, since a method of independently controlling the charging heater 68 and the photoconductor heater 150 is employed, the surface temperature of the photoconductor 21 can be easily adjusted as compared with a method of controlling the surface temperature of the photoconductor 21 by controlling only the charging heater 68. That is, as a charging operation by the charging device 22, the charging heater 68 is mainly used to construct an optimum charging environment, and as a developing operation by the developing machine 24 and a cleaning operation by the cleaning device 26, the photoconductor heater 150 is mainly used to construct an optimum development environment and cleaning environment.

Third Exemplary Embodiment

Figure 11:
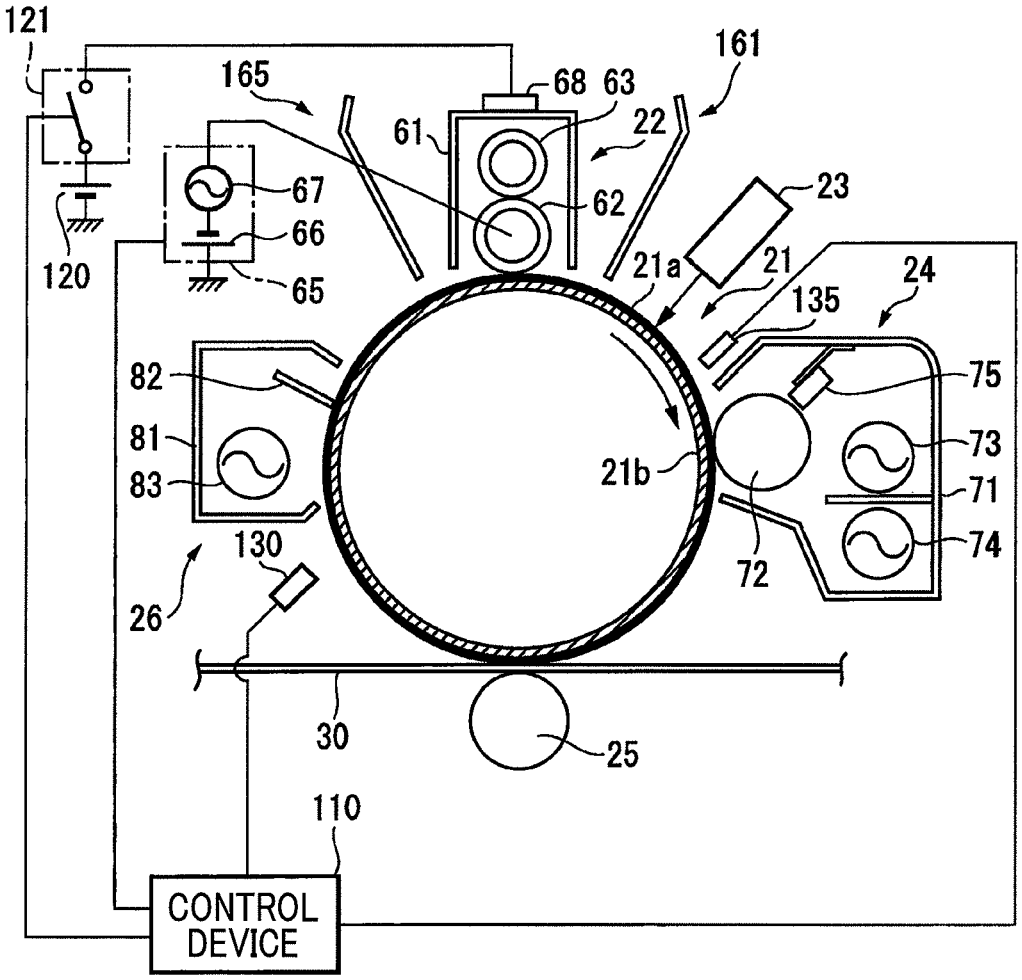
FIG. 11 is an explanatory diagram illustrating major parts around an image forming portion of an image forming apparatus according to a third exemplary embodiment.

FIG. 11 illustrates the major parts of the image forming portion of the image forming apparatus according to a third exemplary embodiment.

In FIG. 11, the basic configuration of the image forming portion 20 is substantially the same as that of the first exemplary embodiment, but unlike the first exemplary embodiment, there is a countermeasure that the secondary trouble associated with the aspect in which the charging heater 68 is attached to the charging device 22 is prevented. Note that, components similar to those in the first exemplary embodiment are denoted by the same reference numerals as those in the first exemplary embodiment, and detailed description thereof will not be repeated here.

In this exemplary embodiment, the charging device 22 includes a charging heater 68 that directly heats the charging housing 61 and the charging roll 62, but a situation in which heat from the charging heater 68 is released to the outside of the charging device 22 cannot be avoided. At this time, the developing machine 24 and the cleaning device 26 are installed in the vicinity of the charging device 22. However, as described above, the developing area Rdv of the developing machine 24 is required to satisfy the temperature condition equal to or lower than the toner heat resistant limit temperature Ttn. Further, the cleaning area Rcn of the cleaning device 26 is required to satisfy a temperature condition equal to or lower than the torque guarantee temperature Ttq. For this reason, the heat from the charging heater 68 should have a reduced effect on the developing machine 24 and the cleaning device 26 positioned in the vicinity of the charging device 22.

Figure 12A:
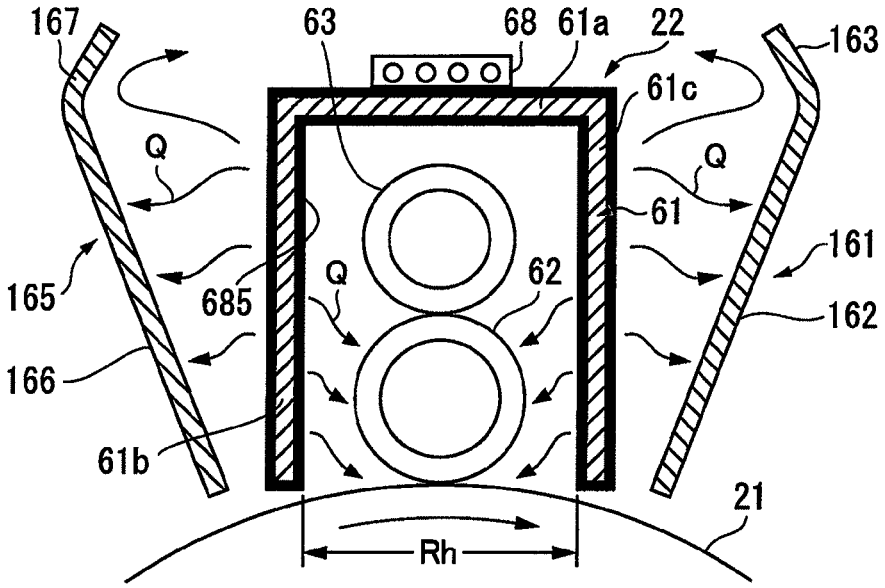
FIG. 12A is an explanatory diagram illustrating a configuration example around a charging device employed in the third exemplary embodiment.

In this exemplary embodiment, as illustrated in FIG. 12A, a first shielding member 161 as a shielding unit is installed downstream of the charging device 22 in the rotational direction of the photoconductor 21, and a second shielding member 165 as a shielding unit is installed upstream of the charging device 22 in the rotational direction of the photoconductor 21.

Here, the first shielding member 161 is provided near the charging device 22 in a region between the charging device 22 and the developing machine 24, and includes flat shielding plate 162 facing the side surface portion 61*c* of the charging housing 61 of the charging device 22 and extending in the radial direction of the drum-shaped photoconductor 21, and forms a bent portion 163 that bends toward the charging housing 61 on the side of the shielding plate 162 that is away from the photoconductor 21.

On the other hand, the second shielding member 165 is provided near the charging device 22 in a region between the charging device 22 and the cleaning device 26, and includes flat shielding plate 166 facing the side surface portion 61*b* of the charging housing 61 of the charging device 22 and extending in the radial direction of the drum-shaped photoconductor 21, and forms a bent portion 167 that bends toward the charging housing 61 on the side of the shielding plate 166 that is away from the photoconductor 21.

Note that, in this exemplary embodiment, aluminum that reflects radiant heat, an ABS resin having a low thermal conductivity, or the like is used as the shielding plates 162 and 166.

Therefore, in this exemplary embodiment, as illustrated in FIG. 12A, the heat from the charging heater 68 heats the charging housing 61 via the thermally conductive member 685, radiant heat Q is generated from the heated charging housing 61, and the surface of the photoconductor 21 is heated in a region Rh facing the openings of the charging roll 62 and the charging housing 61.

Further, as the entire charging housing 61 is heated, the radiant heat Q is also released to the outside of the charging housing 61. The propagation of the radiant heat Q is blocked by the first and second shielding members 161 and 165 installed on the side of the charging housing 61. For this reason, the situation in which the heat from the charging heater 68 gets over the first and second shielding members 161 and 165 and propagates to the developing machine 24 side or the cleaning device 26 side can be prevented. In particular, in this exemplary embodiment, since the first and second shielding members 161 and 165 are formed with bent portions 163 and 167 on the side of the shielding plates 162 and 166 away from the photoconductor 21, the radiant heat Q directed toward the side on the first and second shielding members 161 and 165 away from the photoconductor 21 is held by the bent portions 163 and 167, and as a result, it is difficult to get over the first and second shielding members 161 and 165.

Modification Exemplary Embodiment 3-1

Figure 12B:
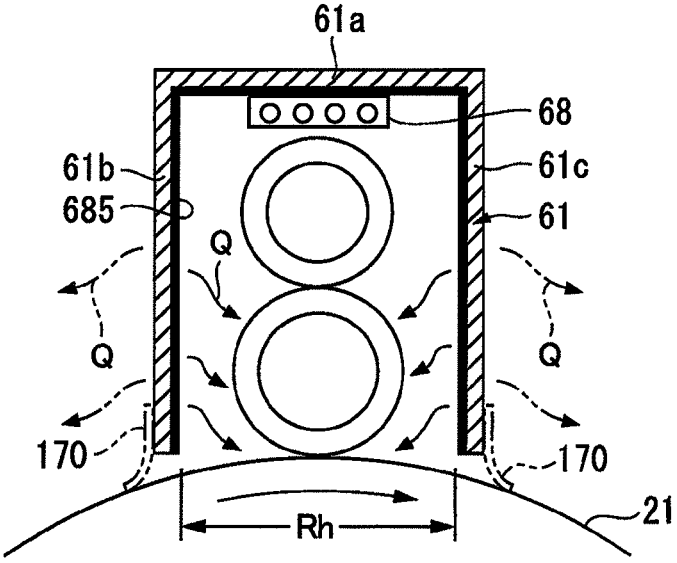
FIG. 12B is an explanatory diagram illustrating the modification exemplary embodiment around the charging device employed in the third exemplary embodiment.

In this exemplary embodiment, the first and second shielding members 161 and 165 are used as the shielding units, but are not limited to this, for example, as in the modification exemplary embodiment 3-1 illustrated in FIG. 12B, those have a structure in which the thermally conductive member 685 is attached only to the inside of the charging housing 61, and the thermally conductive member 685 is not attached to the outside of the charging housing 61, and the charging heater 68 may be disposed in contact with the thermally conductive member 685 inside the charging housing 61.

According to this modification exemplary embodiment, the heat from the charging heater 68 heats the inner surface portion of the charging housing 61 via the thermally conductive member 685, and the surface of the photoconductor 21 is heated with the radiant heat Q in a region Rh facing the openings of the charging roll 62 and the charging housing 61. On the other hand, since the thermally conductive member 685 is not attached to the outer surface of the charging housing 61, the degree of heating of the outer surface of the charging housing 61 by the charging heater 68 is low as compared with the inner surface of the charging housing 61. As a result, the radiant heat Q released from the outer surface of the charging housing 61 is small. As described above, the structure in which the thermally conductive member 685 is not attached to the outer surface of the charging housing 61 functions as a shielding unit that shields the release of the heat to the outside of the charging housing 61.

In addition, in this exemplary embodiment, as indicated by the virtual line in FIG. 12B, a sealing member 170 that can be elastically deformed is provided at an opening edge of the charging housing 61, and a gap between the opening edge of the charging housing 61 and the photoconductor 21 may be closed by the sealing member 170 to prevent the heat in the charging housing 61 from leaking out of the charging housing 61.

Note that, the charging heater 68 is installed on the inside of the charging housing 61, but is not limited to this, for example, as in the modification exemplary embodiment 3-1 illustrated in FIG. 12B, a structure may be employed in which the thermally conductive member 685 is also attached to the inner side of the charging housing 61 while installing the charging heater 68 on the outer side of the back surface portion 61*a* of the charging housing 61 via the thermally conductive member 685, and the thermally conductive member 685 is not attached to the outer surfaces of the side surface portions 61*b* and 61*c* of the charging housing 61 so as to shield the release of the heat from the side surface portions 61*b* and 61*c* of the charging housing 61 to the outside.

Fourth Exemplary Embodiment

Figure 13:
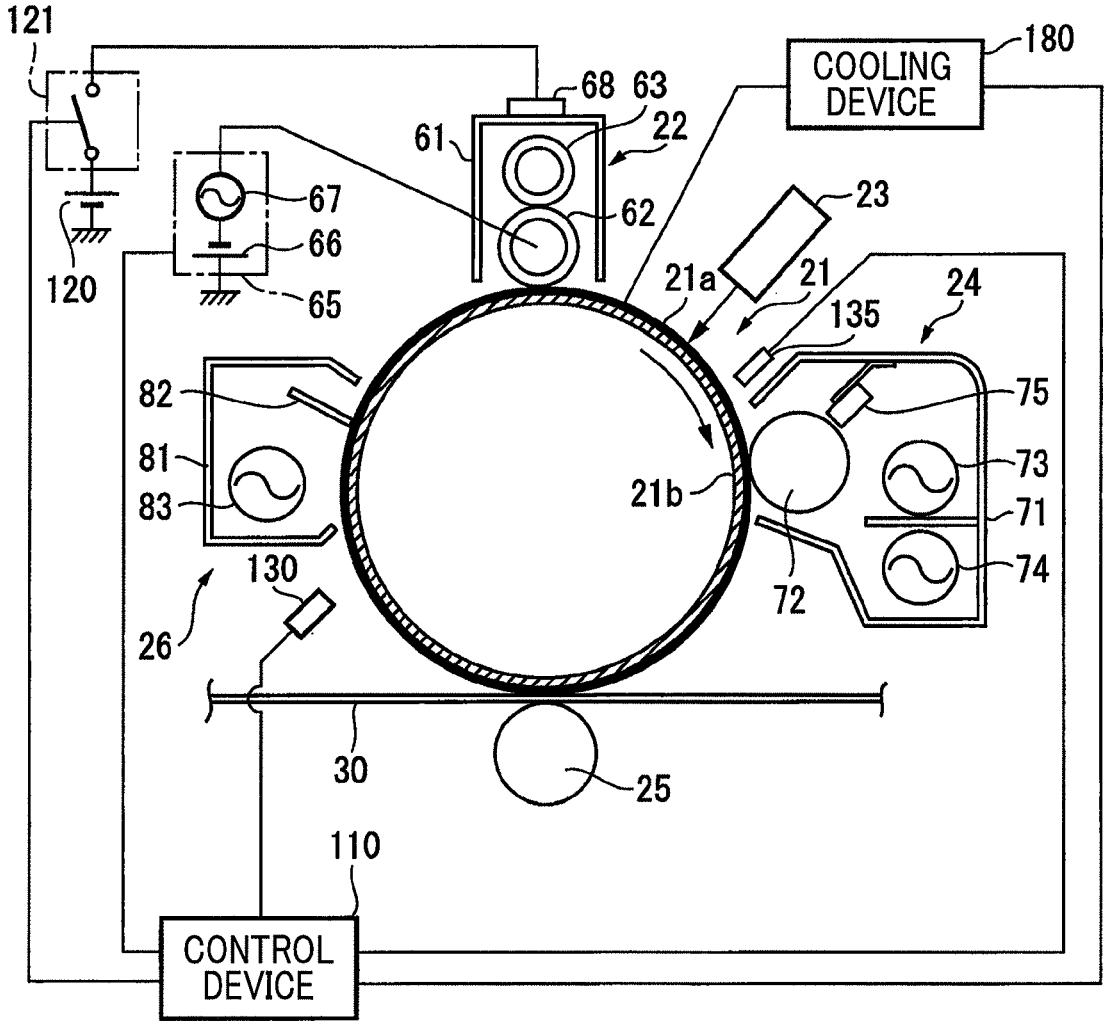
FIG. 13 is an explanatory diagram illustrating major parts around an image forming portion of an image forming apparatus according to a fourth exemplary embodiment.

FIG. 13 illustrates the major parts of the image forming portion of the image forming apparatus according to a fourth exemplary embodiment.

In FIG. 13, the basic configuration of the image forming portion 20 is substantially the same as in the third exemplary embodiment in that there is a countermeasure that the secondary trouble associated with the aspect in which the charging heater 68 is attached to the charging device 22 is prevented. However, unlike the shielding unit of the third exemplary embodiment, as a lowering unit that lowers the surface temperature of the photoconductor 21, a cooling device 180 that cools the surface of the photoconductor 21 is installed. Note that, components similar to those in the third exemplary embodiment are denoted by the same reference numerals as those in the third exemplary embodiment, and detailed description thereof will not be repeated here.

Figure 14A:
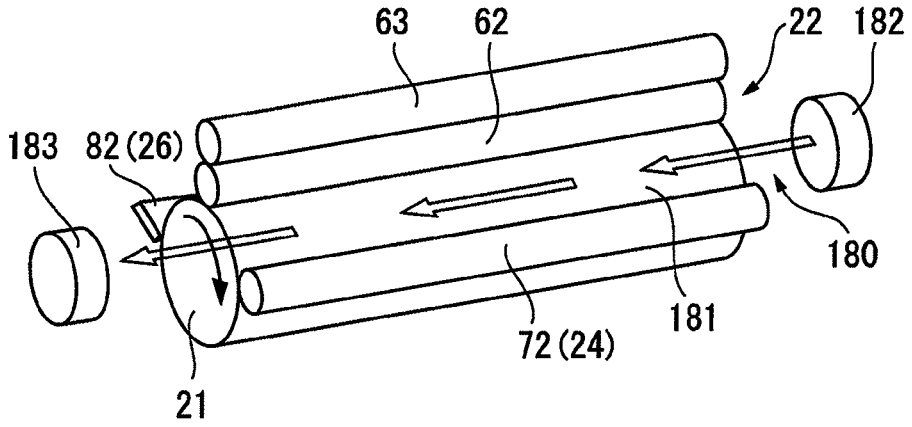
FIG. 14A is an explanatory diagram illustrating a configuration example of a cooling device employed in the fourth exemplary embodiment.

In this exemplary embodiment, for example, the cooling device 180 is arranged as illustrated in FIG. 14A, in which a cooling air passage 181 is secured along the axial direction of the photoconductor 21 at the periphery of the photoconductor 21 in a region between the charging device 22 and the developing machine 24 downstream of the charging device 22 in the rotational direction of the photoconductor 21, a blower fan 182 is installed as an airflow generating unit on one side of the cooling air passage 181, and an exhaust fan 183 is installed on the other side of the cooling air passage 181. Note that, the blower fan 182 and the exhaust fan 183 may be installed exclusively, or may be shared with other units installed in the image forming apparatus.

According to this exemplary embodiment, when the charging device 22 is heated by the charging heater 68, the surface of the photoconductor 21 is heated in the region Rh facing the charging roll 62 in the charging housing 61 and facing the opening of the charging housing 61, and the heat from the charging heater 68 is released to outside the charging device 22.

In this state, when the photoconductor 21 with high surface temperature reaches the developing area Rdv of the developing machine 24, there is a concern that the developing operation by the developing machine 24 may be hindered, and thus in this exemplary embodiment, a method is employed in which the surface of the photoconductor 21 is cooled using the cooling device 180 to lower the surface temperature of the photoconductor 21. For this reason, the surface temperature of the photoconductor 21 that has reached the developing area Rdv of the developing machine 24 is sufficiently lowered, and the developing operation by the developing machine 24 is appropriately performed.

In this exemplary embodiment, the cooling device 180 is installed in a region between the charging device 22 and the developing machine 24 downstream of the charging device 22 in the rotational direction of the photoconductor 21. However, this exemplary embodiment is not limited to this, and a configuration may be employed in which the cooling device 180 is also configured to exert a cooling effect on the region between the charging device 22 and the cleaning device 26 upstream of the charging device 22 in the rotational direction of the photoconductor 21.

Modification Exemplary Embodiment 4-1

Figure 14B:
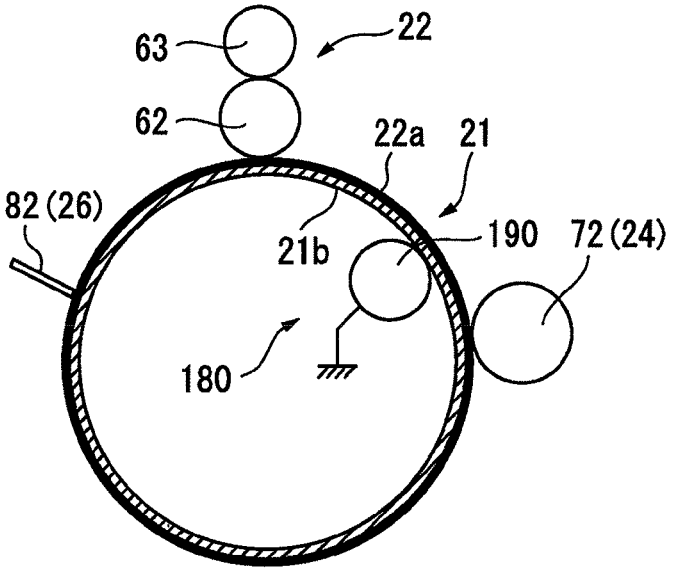
FIG. 14B is an explanatory diagram illustrating another configuration example of the same cooling device.

In this exemplary embodiment, an air cooling type is adopted as the cooling device 180, but is not limited to this. For example, as in the modification exemplary embodiment 4-1 illustrated in FIG. 14B, a cooling roll 190 as a cooling member may be disposed in driven-rotationally contact with a part of the back surface of the drum-shaped base body 21*b* of the photoconductor 21, for example, a portion positioned upstream of the developing area Rdv of the developing machine 24 in the rotational direction of the photoconductor 21, so that the heat accumulated in the photoconductor 21 is released through the cooling roll 190, and as a result, the surface temperature of the photoconductor 21 is lowered.

In this exemplary embodiment, the cooling member is not limited to the cooling roll 190, and an elastically deformable cooling sheet may be elastically brought into contact with a part of the back surface of the drum-shaped base body 21*b*.

In the present exemplary embodiment, the cooling device 180 is employed as a lowering unit that lowers the surface temperature of the photoconductor 21. For example, the shielding unit (first and second shielding members 161 and 165) described in the third exemplary embodiment and the cooling device 180 may be used in combination.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:
a charging roll configured to charge a photoconductor;
a housing that houses the charging roll; and
a heater configured to directly heat the housing or the charging roll,
wherein the heater is disposed in contact with an outside or inside of the housing,
wherein at least a part of the outside or inside of the housing is covered with a thermally conductive member, and
wherein the heater is disposed in contact with the thermally conductive member.

2. The charging device according to claim 1, wherein the heater is disposed to directly heat a surface of the photoconductor as well.

3. A charging device comprising:
a charging roll configured to charge a photoconductor;
a housing that houses the charging roll; and
a heater configured to directly heat the housing or the charging roll, wherein the housing has a heat shielding portion that shields heat from the heater and is located at least either upstream or downstream of the photoconductor in a rotational direction.

4. An image forming apparatus comprising:
a photoconductor configured to hold an image;
a charging device configured to charge the photoconductor;
a developing machine that is provided downstream of the charging device in a rotational direction of the photoconductor and is configured to develop an electrostatic latent image formed after charging of the photoconductor with a developer; and
a cleaning device that is provided upstream of the charging device in the rotational direction of the photoconductor and is configured to remove a residue on the photoconductor,
wherein the charging device comprises:
a charging roll configured to charge the photoconductor;
a housing that houses the charging roll; and
a heater configured to directly heat the housing or the charging roll,
wherein the image forming apparatus further comprises:
a photoconductor heater that is disposed in non-contact with the charging device and is provided separately from the heater of the charging device, and
wherein the photoconductor heater is configured to heat a surface of the photoconductor.

5. The image forming apparatus according to claim 4, wherein the photoconductor heater is configured to directly heat the surface of the photoconductor.

6. The image forming apparatus according to claim 4, wherein the image forming apparatus according is configured to control heating conditions of the heater and the photoconductor heater depending on information on humidity at or around the photoconductor.

7. The image forming apparatus according to claim 4, further comprising:
a shielding unit that is provided in a region between the charging device and the cleaning device and upstream in the rotational direction of the photoconductor,
wherein the shielding unit is configured to shield heat from the heater of the charging device.

8. An image forming apparatus comprising:
a photoconductor configured to hold an image;
a charging device configured to charge the photoconductor;
a developing machine that is provided downstream of the charging device in a rotational direction of the photoconductor and is configured to develop an electrostatic latent image formed after charging of the photoconductor with a developer; and
a cleaning device that is provided upstream of the charging device in the rotational direction of the photoconductor and is configured to remove a residue on the photoconductor,
wherein the charging device comprises:
a charging roll configured to charge the photoconductor;
a housing that houses the charging roll; and
a heater configured to directly heat the housing or the charging roll, and wherein the image forming apparatus further comprises a lowering unit configured to lower a surface temperature of the photoconductor in a region between the charging device and the developing machine downstream of the photoconductor in the rotational direction.

9. The image forming apparatus according to claim 8, wherein the lowering unit is a cooling unit configured to cool a surface of the photoconductor in such a manner as not to be in contact with the surface of the photoconductor.

10. The image forming apparatus according to claim 8, wherein the lowering unit is a shielding unit that is provided between the charging device and the developing machine, and wherein the shielding unit is configured to shield heat from the heater of the charging device.

11. The image forming apparatus according to claim 8, wherein the lowering unit is configured to lower the surface temperature of the photoconductor facing the developing machine to a temperature equal to or lower than an allowable heat-resistant temperature of the developer.

* * * * *